US007413443B1

(12) United States Patent
Ju

(10) Patent No.: US 7,413,443 B1
(45) Date of Patent: Aug. 19, 2008

(54) ELECTRICAL CONNECTOR

(75) Inventor: De Siang Ju, Keelung (TW)

(73) Assignee: Lotes Co., Ltd., Anloku, Keelung (TW)

( * ) Notice: Subject to any disclaimer, the term of this patent is extended or adjusted under 35 U.S.C. 154(b) by 0 days.

(21) Appl. No.: 11/870,869

(22) Filed: Oct. 11, 2007

(51) Int. Cl.
*H01R 12/00* (2006.01)

(52) U.S. Cl. ..... 439/66; 439/71; 439/591

(58) Field of Classification Search ..... 439/66, 439/71, 591
See application file for complete search history.

(56) References Cited

U.S. PATENT DOCUMENTS 5,324,205 A * 6/1994 Ahmad et al. ..... 439/66
6,561,819 B1 * 5/2003 Huang et al. ..... 439/66
6,814,586 B1 * 11/2004 Ju ..... 439/66

* cited by examiner

*Primary Examiner*—Truc T Nguyen
(74) *Attorney, Agent, or Firm*—Morris Manning Martin LLP; Tim Tingkang Xia, Esq.

(57) ABSTRACT

The invention discloses an electrical connector comprising an insulating housing and a plurality of terminals. The insulating housing comprises a base having at least one group of slots and at least one block portion. Each terminal is inserted into one of the slots. A first position and a second position are respectively defined according to the contact between the terminal and the slot. A base line is defined from one end of the block portion away from the base. A first distance is defined from the base line to the first position. A second distance is defined from the first position to the second position. A third distance is defined from the base line to the position where the terminal protrudes from the block portion. The first distance is larger than or equal to 1.5 times the second distance, and the third distance is smaller than the first distance.

22 Claims, 6 Drawing Sheets

ELECTRICAL CONNECTOR

BACKGROUND OF THE INVENTION

1. Field of the Invention

This invention relates to an electrical connector and, more particularly, to an electrical connector whose terminals are disposed more closely.

2. Description of the Prior Art

With the development of the computer technology, there is a tendency towards miniaturization. The electrical connectors used in a package of LGA (Land Grid Array) are getting smaller. An electrical connector mainly includes an insulating housing and a plurality of terminals. With the electrical connector getting smaller, the size of the terminals of the electrical connector turns smaller, which results the terminals are easily damaged by the stress generated by the contact of the electrode and the terminals when an electrical component (such as a central processing unit) is disposed to the electrical connector.

Referring to FIG. 1, FIG. 1 is a schematic diagram illustrating an electrical component 1 being disposed to the electrical connector 2 in the prior art. The electrical connector 2 includes a plurality of terminals 20 and the insulating housing 21. The terminal 20 is connected to an electrode 10 by a contacting end 200. The insulating housing 21 has a block portion 210. A distance C is defined from a bending portion 204 of the terminal 20 to a top surface 2100 of the insulating housing 21, and a distance D is defined from a bending portion 204 of the terminal 20 to a bottom surface 212 of the insulating housing 21. Because the distance C is smaller than the distance D (i.e. the length of a fixed portion 202 of the terminal 20 is longer than the deformable length of an elastic portion 203 of the terminal 20), the elasticity of the terminal 20 is worse and the capability of bearing normal force of the terminal 20 is smaller when the terminal 20 is pressed.

Moreover, a distance A is defined from the contacting end 200 to the fixed portion 202, and a distance B is defined by two adjacent slots. Because the distance A is just a little larger than the distance B, the terminals 20 can not be disposed very closely, so as to constraint the designing size.

To sum up, traditional electrical connectors have following disadvantages: (1) the elasticity of the terminal is worse and the capability of bearing normal force of the terminal is smaller when the terminal is pressed; (2) the terminals can not be disposed very closely, so as to constraint the designing size.

Accordingly, the scope of the invention is to provide an electrical connector, so as to solve the foregoing problems

SUMMARY OF THE INVENTION

One scope of the invention is to provide an electrical connector on which the plurality of terminals can be disposed more closely and suit the miniaturization of electrical components.

According to an embodiment, the electrical connector of the invention includes an insulating housing and a plurality of terminals. The insulating housing includes a base having at least one group of slots wherein each slot is aslope disposed in the same direction with respect to the base. One end of each slot exposes from a side surface of the base, and at least one block portion is disposed around the base and near the side surface.

Each of the terminals is respectively inserted into one of the slots and protrudes from one end of the block portion away from the base. A first position is defined according to the contact between the terminal and the slot and close to the side surface, and a second position is defined according to the contact between the terminal and the slot and away from the side surface. A base line, parallel to the base, is defined from one end of the block portion away from the base. A first distance is defined perpendicularly from the base line to the first position, a second distance opposite to the first distance is defined straightly from the first position to the second position, and a third distance is defined perpendicularly from the base line to a position where the terminal protrudes from the block portion and away from the base line.

In the embodiment, the first distance is larger than or equal to 1.5 times the second distance, and the third distance is smaller than the first distance. According to the electrical connector of the invention, the capability of bearing normal force is larger when the terminals are pressed. In other words, the elasticity is better when the terminals are pressed. By this way, the terminals can be disposed more closely.

The advantage and spirit of the invention may be understood by the following recitations together with the appended drawings.

DETAILED DESCRIPTION OF THE INVENTION

Figure 1:
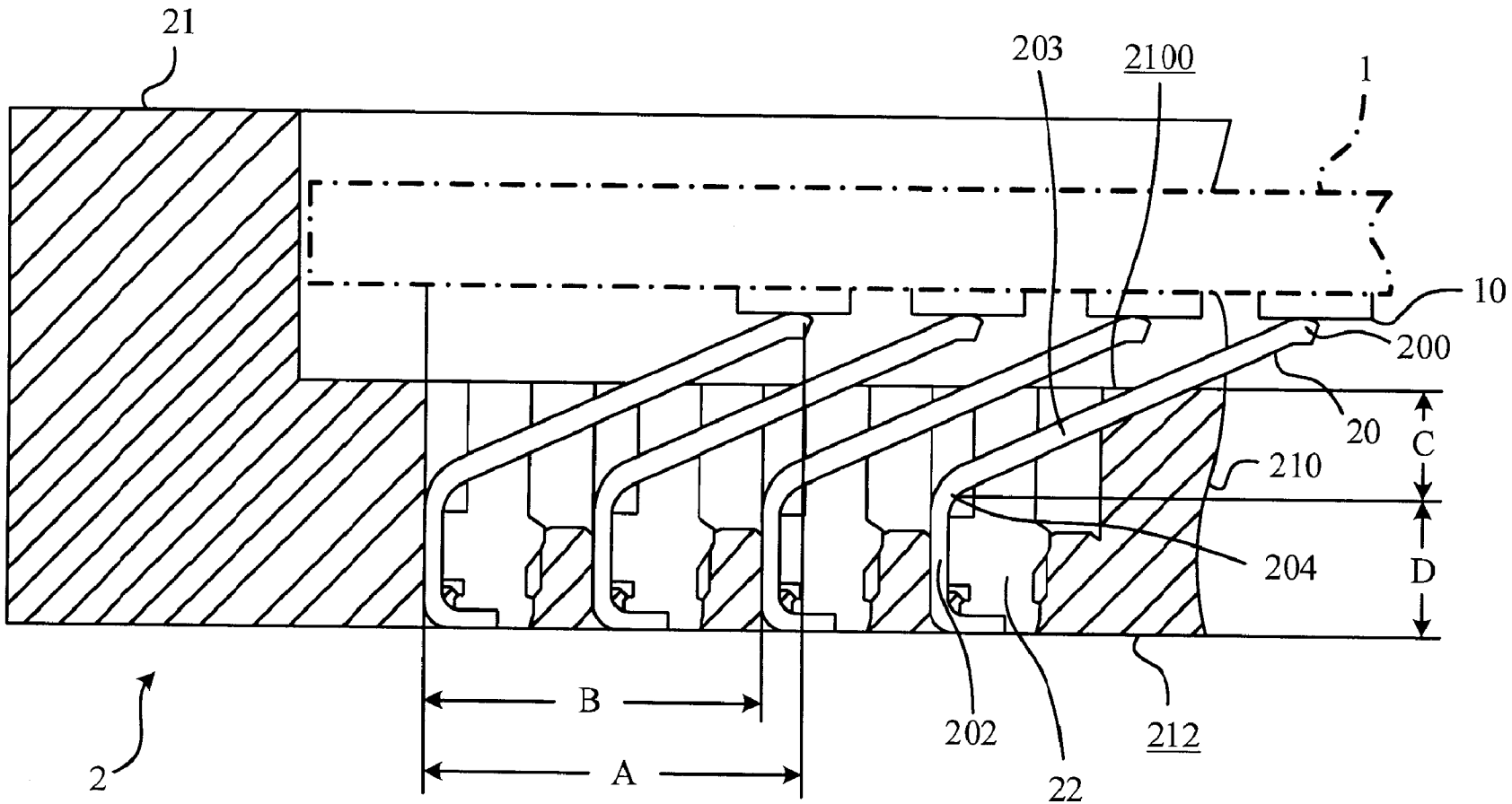
FIG. 1 (Prior Art)
FIG. 1 is a schematic diagram illustrating an electrical component disposed to the electrical connector in the prior art.
Figure 2:
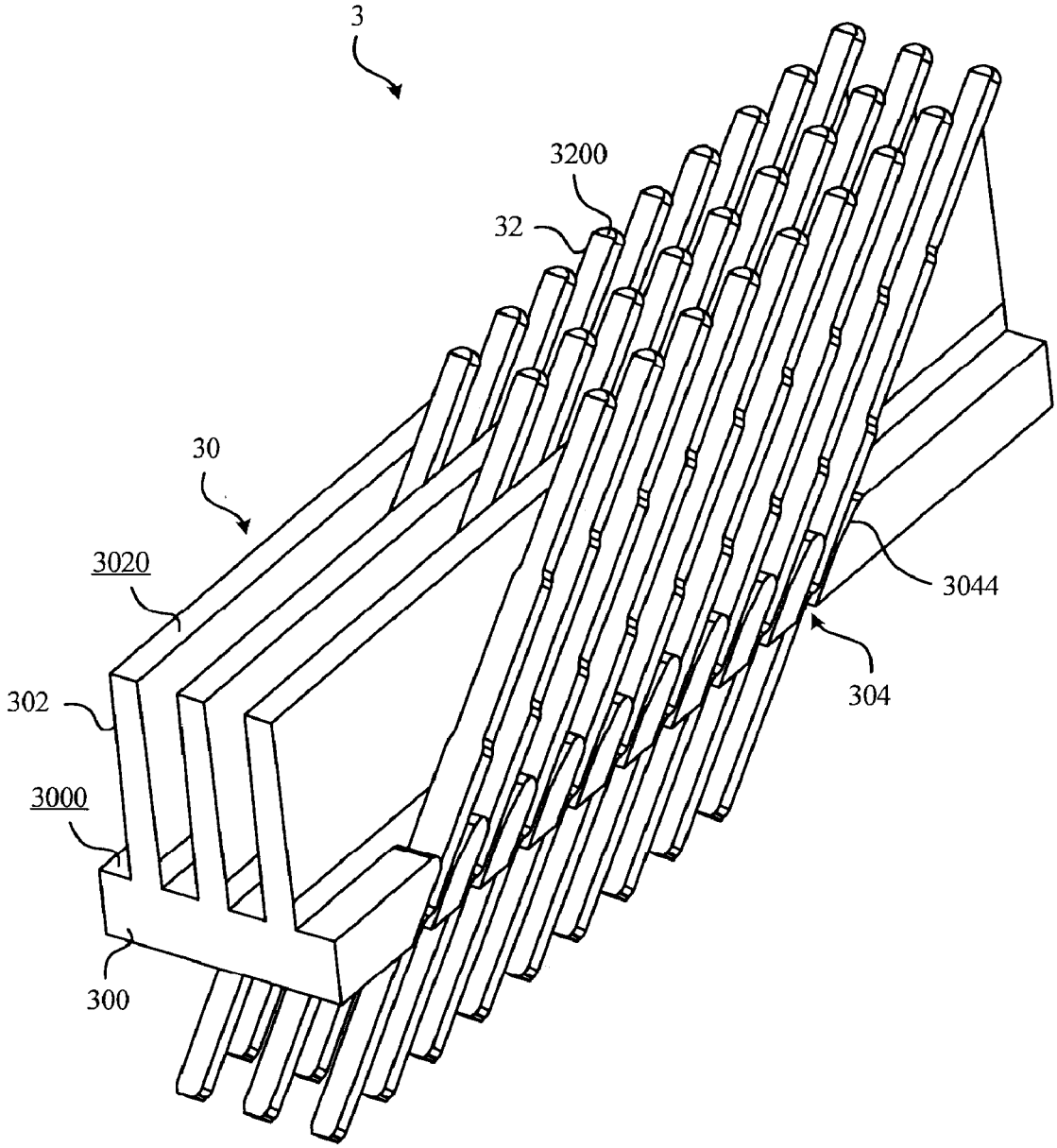
FIG. 2 is an appearance view illustrating the electrical connector according to an embodiment of the invention.
Figure 3:
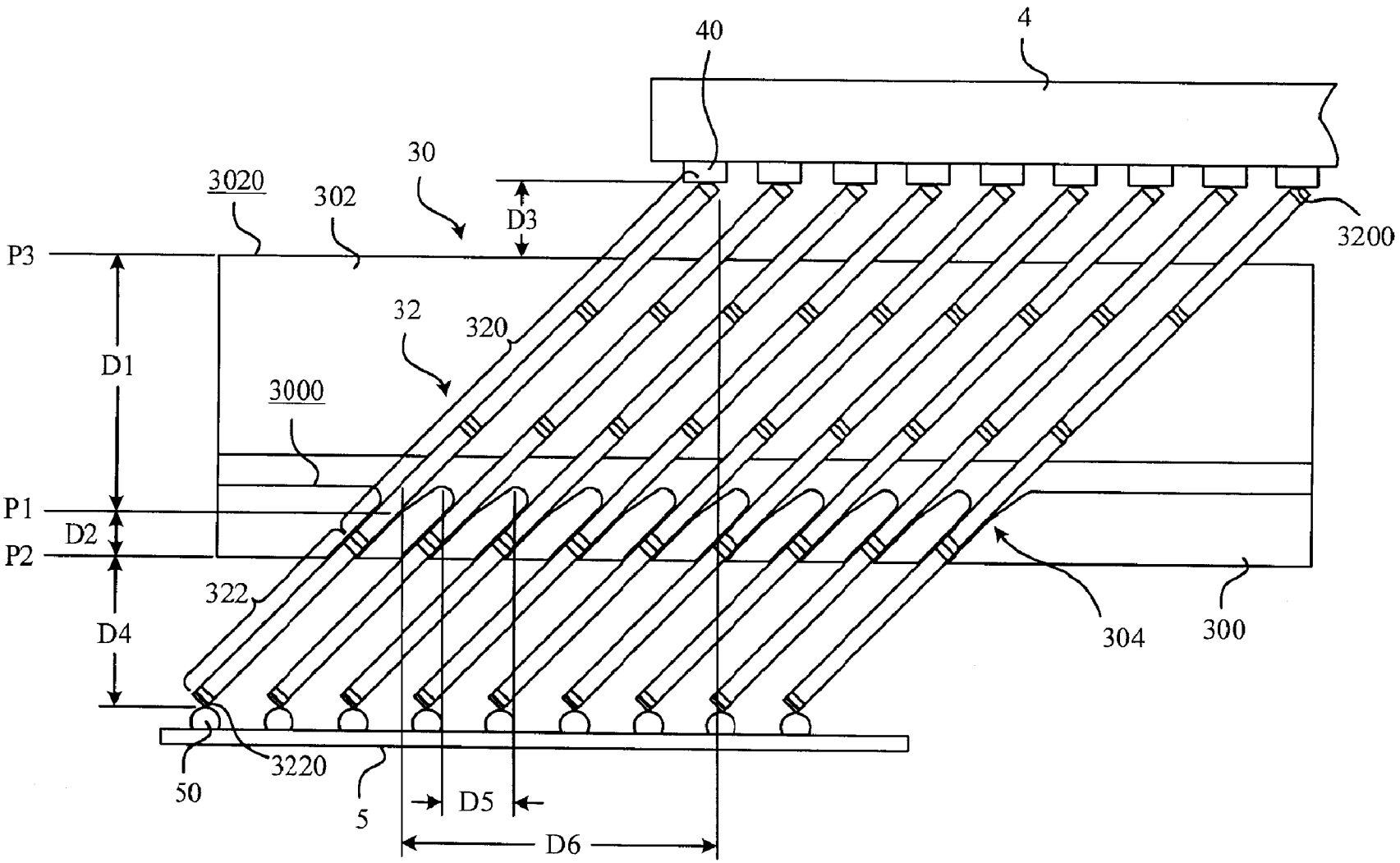
FIG. 3 is a side view illustrating the electrical connector with the electrical component and the circuit board in FIG. 2.
Figure 4:
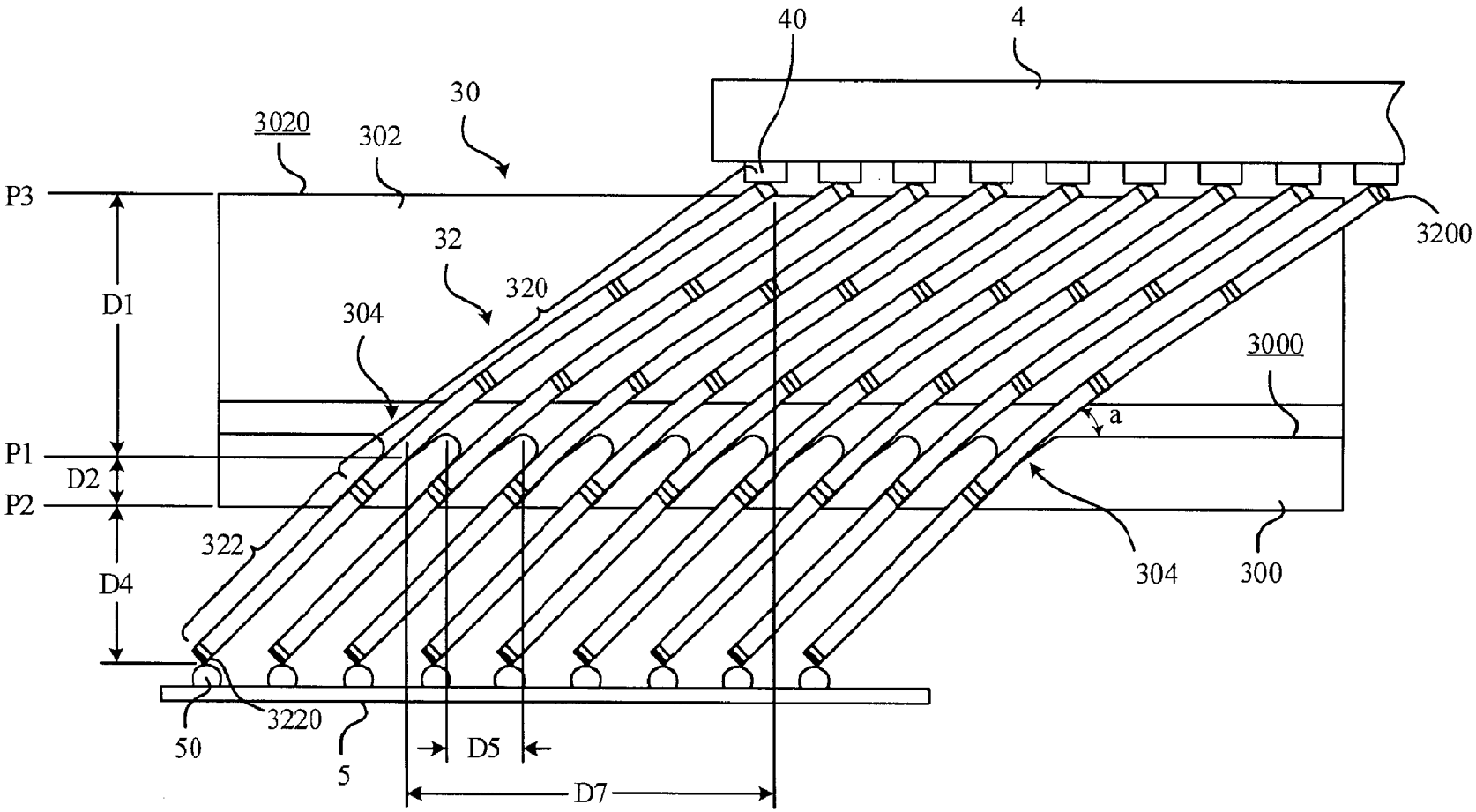
FIG. 4 is a side view illustrating pressing downward the electrical component in FIG. 3.
Figure 5A:
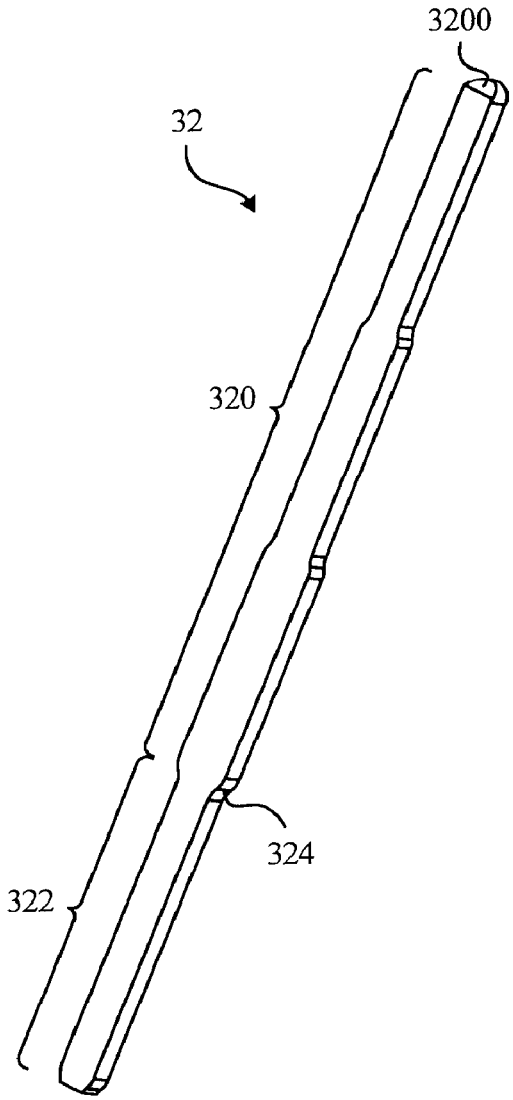
FIG. 5A is an appearance view illustrating the terminals in FIG. 2.
Figure 5B:
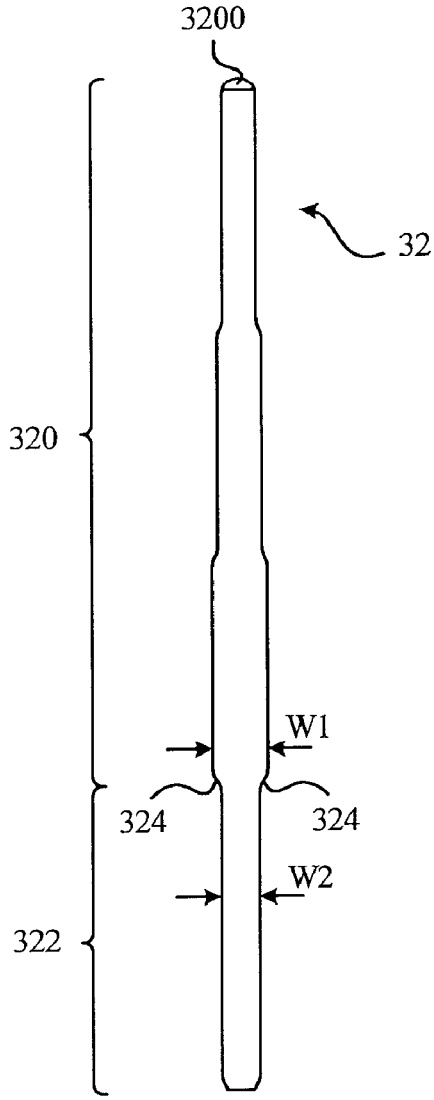
FIG. 5B is a side view illustrating the terminals in FIG. 5A.
Figure 6:
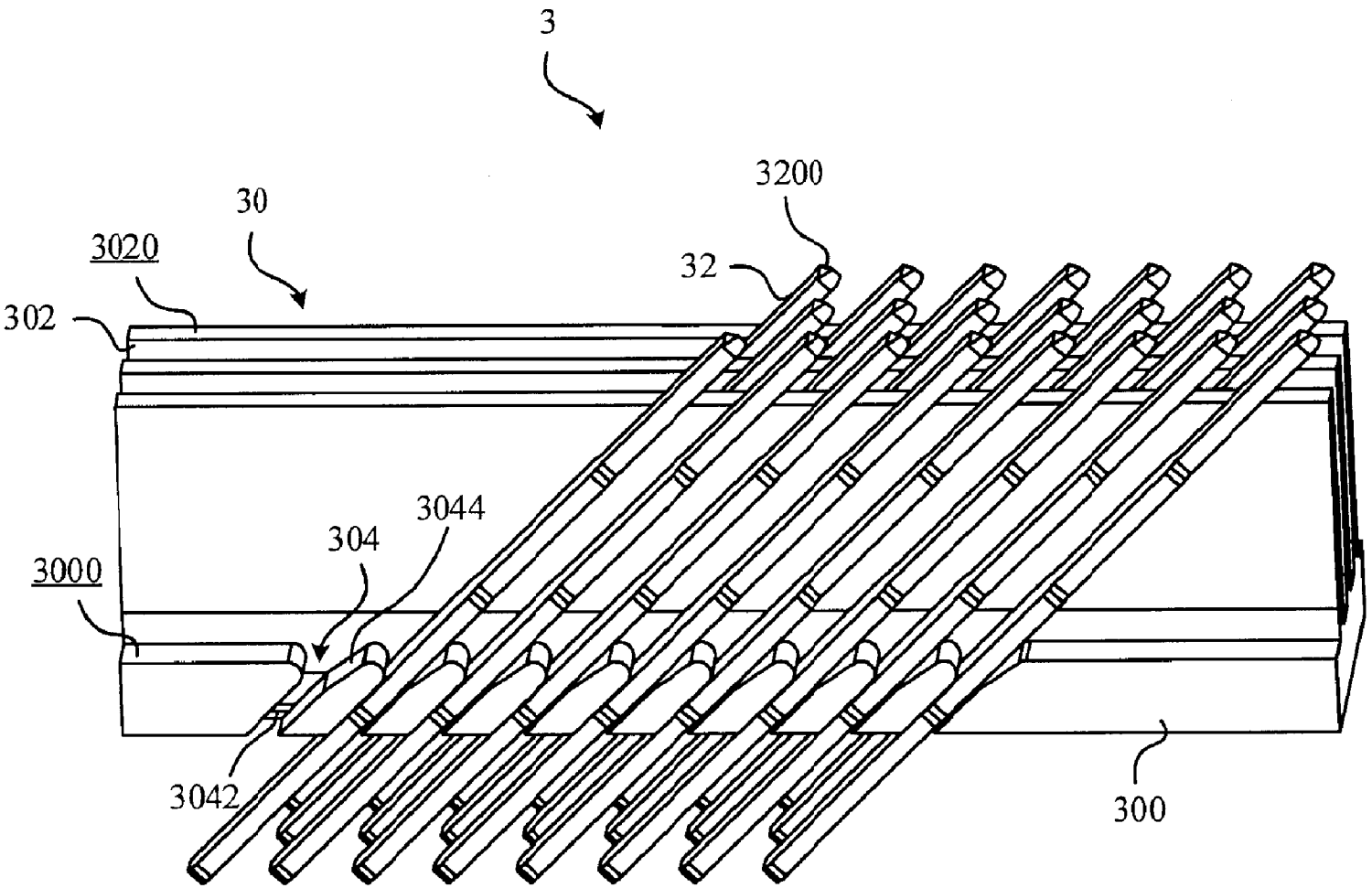
FIG. 6 is an appearance view illustrating another angle of view of the electrical connector in FIG. 2.

Referring to FIGS. 2 to 6, FIG. 2 is an appearance view illustrating the electrical connector 3 according to an embodiment of the invention. FIG. 3 is a side view illustrating the electrical connector 3 with the electrical component 4 and the circuit board 50 in FIG. 2. FIG. 4 is a side view illustrating the pressed electrical component 4 in FIG. 3. FIG. 5A is an appearance view illustrating the terminals 32 in FIG. 2. FIG. 5B is a side view illustrating the terminals 32 in FIG. 5A. FIG. 6 is an appearance view illustrating another angle of view of the electrical connector 3 in FIG. 2.

The electrical connector 3 of the invention includes an insulating housing 30 and a plurality of terminals 32. The insulating housing 30 includes a base 300 which has at least one group of slots 304 wherein each slot 304 is aslope disposed in the same direction with respect to the base 300. And, one end of each slot 304 exposes from a side surface 3000 of the base 300, and at least one block portion 302 is disposed around the base 300 and near the side surface 3000.

In the embodiment, the block portion 302 extends from the base 300, but it will not be limited by this arrangement. As shown in FIG. 3, three parallel block portions 302 are disposed near the side surface 3000 and around the base 300. Each group of slots 304 (only one group of slots 304 shown in FIG. 3) is in staggered arrangement with the block portions 302.

Each of the terminals 32 has a first elastic portion 320 and a second elastic portion 322. Each terminal 32 is inserted in one of the slots 304 respectively and has a first elastic portion 320 and a second elastic portion 322. The first elastic portion 320 protrudes from one end of the block portion 302 away from the base 300. The second elastic portion 322 protrudes from another end of the slot 304 away from the base 300.

A first position P1 is defined according to the contact between the terminal 32 and the slot 304 and close to the side surface 3000, and a second position P2 is defined according to the contact between the terminal 32 and the slot 304 and away from the side surface 3000. A base line P3, parallel to the base 300, is defined from one end of the block portion 302 away from the base 300. A distance D1 is defined perpendicularly from the base line P3 to the first position P1, a distance D2 opposite to the first distance P1 is defined straightly from the first position P1 to the second position P2, a distance D3 is defined perpendicularly from the base line P3 to a position where the first elastic portion 320 of the terminal 32 protrudes from the block portion 302 and away from the base line P3, and a distance D4 is defined perpendicularly from the second position P2 to a position where the second elastic portion 322 of the terminal 32 protrudes from the slot 304 and away from the second position P2. It is notable that the top surface 3032 of the block portion 302 and the base line P3 both are at the same plane.

In the embodiment, the distance D1 is larger than or equal to 1.5 times the distance D2, and the distance D3 is smaller than the distance D1. As shown in FIG. 5, by this way, the capability of bearing normal force of the terminals 32 is larger and the elasticity of the terminals 32 is better when the electrical component 4 is pressed. Furthermore, the distance D4 is larger than distance D3.

As shown in FIG. 3, a contact surface 3200 is formed at a position where the terminal 32 protrudes from the block portion 304 away from the base line P3. A distance D5 is defined by every other adjacent slots 304, a distance D6 is defined from the contact surface 3200 of the terminal 32 to the slot 304 in which the terminal 32 is disposed, and the distance D6 is larger than or equal to 4 times the distance D5. Furthermore, the contact surface 3200 of the terminal 32 can contact the electrode 40 of the electrical component 4 in points or the surface. The contacting end 3220 of the second elastic portion 322 can contact the contact 50 on the circuit board 5. In the practical application, the contacting end 3220 of the second elastic portion 322 can be fixed to the contact 50 on the circuit board 5 by using solder.

In the embodiment, as shown in FIG. 3, the slots 304 of each group are aligned in the same direction. And, there are at least four terminals 32 protruding from the underside of the contact surface 3200 of a single terminal 32 when the electrical component 4 is not be pressed. As shown in FIG. 4, when the terminal 32 is pressed, an included angle between the first elastic portion 320 and the side surface 3000 of the base 300 is between 20 degree and 60 degree. Furthermore, when the terminal 32 is pressed, a distance D7 is defined from the contact surface 3200 of the terminal 32 to the slot 304 in which the terminal 32 is disposed, and the distance D7 is larger than or equal to 5 times the distance D5.

As shown in FIG. 5B, the maximum width of the first elastic portion 320 of the terminal 32 is W1, and the maximum width of the second elastic portion 322 is W2. In the embodiment, the width W1 is larger than the width W2. It should be noted that the width of the first elastic portion 320 or the second elastic portion 322 can be designed in accordance with practical applications.

As shown in FIG. 6, the slot 304 has a shoulder 3042. As shown in FIGS. 5A and 5B, a cervix 324 exists between the first elastic portion 320 and the second elastic portion 322. In the embodiment, the terminal 32 is disposed in the slot 304 by leaning the cervix 324 on the shoulder 3042.

Moreover, as shown in FIG. 6, the inner wall 3040 of the slot 304 has an inclined plane 3044. By this, the terminal 32 can be easily inserted into the slot 304 or removed from the slot 304. When the terminal 32 is pressed, the first elastic portion 320 can deform along the inclined plane 3044, so as to provide better elasticity.

Compared with the prior art, the electrical connector of the invention has the following advantages: (1) the elasticity of the terminal is better and the capability of bearing normal force is larger when the terminal is pressed; (2) the terminals can be disposed very closely, so as to suit the miniaturizing design of electrical components.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An electrical connector comprising:

an insulating housing comprising a base having at least one group of slots wherein each slot is aslope disposed in the same direction with respect to the base, one end of each slot exposing from a side surface of the base, and at least one block portion disposed around the base and near the side surface;

a plurality of terminals, each of which respectively being inserted into one of the slots and protruding from one end of the block portion away from the base, a first position being defined according to the contact between the terminal and the slot and close to the side surface, a second position being defined according to the contact between the terminal and the slot and away from the side surface; and a base line, parallel to the base, being defined from one end of the block portion away from the base, a first distance being defined perpendicularly from the base line to the first position, a second distance opposite to the first distance being defined straightly from the first position to the second position, a third distance being defined perpendicularly from the base line to a position where the terminal protrudes from the block portion and away from the base line;

wherein the first distance is larger than or equal to 1.5 times the second distance, and the third distance is smaller than the first distance.

2. The electrical connector of claim 1, wherein the block portion extends from the base.

3. The electrical connector of claim 1, wherein the block portion has a top surface, and the top surface and the base line both are at the same plane.

4. The electrical connector of claim 1, wherein a contact surface is formed at a position where the terminal protrudes from the block portion and away from the base line.

5. The electrical connector of claim 4, wherein a fourth distance is defined by every other adjacent slots, a fifth distance is defined from the contact surface of the terminal to the slot in which the terminal is disposed, the fifth distance is larger than or equal to 4 times the fourth distance.

6. The electrical connector of claim 4, wherein when the contact surface of the terminal is pressed, a sixth distance is defined from the contact surface of the terminal to the slot in which the terminal is disposed, the sixth distance is larger than or equal to 5 times the fourth distance.

7. The electrical connector of claim 4, wherein the slots of each group are aligned in the same direction, such that at least four terminals protrude from the underside of the contact surface of a single terminal.

8. The electrical connector of claim 4, wherein when the contact surface of the terminal is pressed, an included angle between the terminal and the side surface of the base is between 20 degree and 60 degree.

9. The electrical connector of claim 1, wherein a seventh distance is defined perpendicularly from the second position to a position where the terminal protrudes from the slot and away from the second position, the seventh distance is larger than the third distance.

10. The electrical connector of claim 1, wherein each of the terminals has a first elastic portion and a second elastic portion, a maximum width of the first elastic portion is larger than that of the second elastic portion.

11. The electrical connector of claim 10, wherein the slot has a shoulder, a cervix exists in between the first elastic portion and the second elastic portion, the terminal is disposed in the slot by leaning the cervix on the shoulder.

12. An electrical connector comprising:

an insulating housing comprising a base having at least one group of slots wherein each slot is aslope disposed in the same direction with respect to the base, one end of each slot exposing from a side surface of the base, and at least one block portion disposed around the base and near the side surface;

a plurality of terminals, each of which respectively being inserted into one of the slots and having a first elastic portion and a second portion, the first elastic portion protruding from one end of the block portion away from the base, the second elastic portion protruding from another end of the slot away from the base, a first position being defined according to the contact between the terminal and the slot and close to the side surface, a second position being defined according to the contact between the terminal and the slot and away from the side surface; and a base line, parallel to the base, being defined from one end of the block portion away from the base, a first distance being defined perpendicularly from the base line to the first position, a second distance opposite to the first distance being defined straight from the first position to the second position, a third distance being defined perpendicularly from the base line to a position where the first elastic portion of the terminal protrudes from the block portion and away from the base line;

wherein the first distance is larger than or equal to 1.5 times the second distance, and the third distance is smaller than the first distance.

13. The electrical connector of claim 12, wherein the block portion extends from the base.

14. The electrical connector of claim 12, wherein the block portion has a top surface, and the top surface and the base line both are at the same plane.

15. The electrical connector of claim 12, wherein a contact surface is formed at a position where the terminal protrudes from the block portion away from the base line.

16. The electrical connector of claim 15, wherein a fourth distance is defined by every other adjacent slots, a fifth distance is defined from the contact surface of the terminal to the slot in which the terminal is disposed, the fifth distance is larger than or equal to 4 times the fourth distance.

17. The electrical connector of claim 15, wherein when the contact surface of the terminal is pressed, a sixth distance is defined from the contact surface of the terminals to the slot in which the terminal is disposed, the sixth distance is larger than or equal to 5 times the fourth distance.

18. The electrical connector of claim 15, wherein the slots of each group are aligned in the same direction, such that at least four terminals protrude from the underside of the contact surface of a single terminal.

19. The electrical connector of claim 15, wherein when the contact surface of the terminal is pressed, an included angle between the terminal and the side surface of the base is between 20 degree and 60 degree.

20. The electrical connector of claim 12, wherein a seventh distance is defined perpendicularly from the second position to a position where the second elastic portion of the terminal protrudes from the slot and away from the second position, the seventh distance is larger than the third distance.

21. The electrical connector of claim 12, wherein a maximum width of the first elastic portion is larger than that of the second elastic portion.

22. The electrical connector of claim 12, wherein the slot has a shoulder, a cervix exists in between the first elastic portion and the second elastic portion, the terminal is disposed in the slot by leaning the cervix on the shoulder.

* * * * *